US012123660B2

(12) United States Patent
Petersen et al.

(10) Patent No.: US 12,123,660 B2
(45) Date of Patent: Oct. 22, 2024

(54) PLATE-TYPE HEAT EXCHANGER

(71) Applicant: Danfoss A/S, Nordborg (DK)

(72) Inventors: Jes Petersen, Kolding (DK); Ivan Knudsen, Bjerringbro (DK); Helge Nielsen, Sydals (DK)

(73) Assignee: DANFOSS A/S, Nordborg (DK)

( * ) Notice: Subject to any disclaimer, the term of this patent is extended or adjusted under 35 U.S.C. 154(b) by 279 days.

(21) Appl. No.: 17/084,864

(22) Filed: Oct. 30, 2020

(65) Prior Publication Data

US 2021/0131737 A1 May 6, 2021

(30) Foreign Application Priority Data

Nov. 4, 2019 (DK) ..... PA201901289

(51) Int. Cl.

| | |
|---|---|
| ***F28D 9/00*** | (2006.01) |
| ***F28F 3/08*** | (2006.01) |
| ***F28F 3/10*** | (2006.01) |
| ***F28F 9/007*** | (2006.01) |
| ***F28F 21/06*** | (2006.01) |

(52) U.S. Cl.

CPC ..... *F28D 9/005* (2013.01); *F28F 3/086* (2013.01); *F28F 3/10* (2013.01); *F28F 9/0075* (2013.01); *F28F 21/065* (2013.01)

(58) Field of Classification Search

CPC ..... F28D 9/005; F28D 9/0075; F28F 3/086; F28F 3/10; F28F 3/027; F28F 9/0075

See application file for complete search history.

(56) References Cited

U.S. PATENT DOCUMENTS

| | | | | | |
|---|---|---|---|---|---|
| 3,792,730 | A * | 2/1974 | Andersson | F28F 3/10 | 165/167 |
| 4,063,591 | A * | 12/1977 | Usher | F28F 3/083 | 165/167 |
| 4,146,090 | A * | 3/1979 | Nakayama | F28F 3/10 | 165/167 |
| 4,403,652 | A * | 9/1983 | Schiltz | F28F 9/0275 | 165/167 |
| 4,432,415 | A * | 2/1984 | Wright | F16J 15/104 | 165/166 |

(Continued)

FOREIGN PATENT DOCUMENTS

| | | |
|---|---|---|
| CN | 105074374 A | 11/2015 |
| CN | 106716043 A | 5/2017 |

(Continued)

OTHER PUBLICATIONS

Extended European Search Report for European Patent Application No. 20192692.0 dated Mar. 16, 2021.

*Primary Examiner* — Ana M Vazquez

(74) *Attorney, Agent, or Firm* — McCormick, Paulding & Huber PLLC

(57) ABSTRACT

A plate-type heat exchanger is described comprising a stack of heat exchanger plates (2*b*) forming a first flow path and a second flow path, wherein each heat exchanger plate (2*b*) comprises an opening (7*b*) in an opening area (8*b*), the opening area (8*b*) being connected to one of the two flow paths and sealed against the other of the two flow paths by means of a gasket arrangement (11*b*). Such a plate-type heat exchanger should be suitable for high pressures without increasing the risk of leakages. To this end a support element (15) is arranged in the sealed opening area (8*b*).

20 Claims, 1 Drawing Sheet

(56) References Cited

U.S. PATENT DOCUMENTS

| | | | | | |
|---|---|---|---|---|---|
| 4,646,821 | A * | 3/1987 | Almqvist | F28F 3/10 165/167 |
| 4,976,313 | A * | 12/1990 | Dahlgren | F28F 3/083 165/167 |
| 5,435,383 | A * | 7/1995 | Rajagopal | F28F 3/10 165/167 |
| 5,522,462 | A * | 6/1996 | Kumar | F28F 3/083 165/166 |
| 6,070,658 | A | 6/2000 | Cipriani | |
| 6,073,687 | A | 6/2000 | Jensen et al. | |
| 7,424,908 | B2 * | 9/2008 | Blomgren | F28F 3/10 165/167 |
| 11,156,405 | B2 * | 10/2021 | Blomgren | F28F 3/10 |
| 2001/0030043 | A1 | 10/2001 | Gleisle et al. | |
| 2010/0276125 | A1 | 11/2010 | Krantz et al. | |
| 2017/0268832 | A1 * | 9/2017 | Christensen | F28F 3/083 |

FOREIGN PATENT DOCUMENTS

| | | | |
|---|---|---|---|
| EP | 3 001 131 | A1 | 3/2016 |
| GB | 2 092 241 | A | 8/1982 |
| RU | 2011 123 885 | A | 12/2012 |
| RU | 2 472 091 | C1 | 1/2013 |
| RU | 2 474 779 | C1 | 2/2013 |
| WO | 2006/080874 | A1 | 8/2006 |
| WO | 2010/056183 | A2 | 5/2010 |

* cited by examiner

PLATE-TYPE HEAT EXCHANGER

CROSS-REFERENCE TO RELATED APPLICATION

This application claims foreign priority benefits under 35 U.S.C. § 119 to Danish Patent Application No. PA201901289 filed on Nov. 4, 2019, the content of which is hereby incorporated by reference in its entirety.

TECHNICAL FIELD

The present invention relates to a plate-type heat exchanger comprising a stack of heat exchanger plates forming a first flow path and a second flow path, wherein each heat exchanger plate comprises an opening in an opening area, the opening area being connected to one of the two flow paths and sealed against the other of the two flow paths by means of a gasket arrangement.

BACKGROUND

In such a heat exchanger the heat exchanger plates form means for transferring heat from the first flow path to the second flow path or vice versa. Thus, every second space between the heat exchanger plates belong to the first flow path and the remaining spaces belong to the second flow path.

In many cases each heat exchanger plate comprises four openings, wherein one pair of openings is used for supplying and returning fluid to the first flow path and the other pair of openings is used for supplying and returning fluid to the second flow path. In most cases, the openings are arranged near the corners of the heat exchanger plates. Each opening is arranged in an opening area.

When the heat exchanger plates are stacked together the four openings of the heat exchanger plates form four thoroughgoing channels. In order to connect each channel only to the corresponding flow path, two opening areas are connected to the representative flow path and the other two opening areas are sealed against this flow path, more precisely against the respective heat exchange area of this flow path.

In some cases, in particular when the heat exchanger is used with high pressures, this leads to a situation in which the sealed opening area experiences a pressure different from the non-sealed area on the other side of the heat exchanger plate. This can lead to a deformation of the heat exchanger plate enabling the gasket arrangement in the area to be pushed out of position.

SUMMARY

The object underlying the present invention is to make a plate-type heat exchanger suitable for high pressures without increasing the risk of leakages.

This object is solved with a plate-type heat exchanger as described in the outset in that a support element is arranged in the sealed opening area.

The support element is able to prevent a deformation of a heat exchanger plate due to a pressure difference or to limit such a deformation to an extent in which the risk that the gasket is pushed out of position, is minimized. Thus, the heat exchanger can be kept tight even under higher pressures.

In an embodiment of the invention the gasket arrangement comprises a first gasket between the fluid path and the opening area and a second gasket between the support element and the opening. In such an embodiment the space between the two gaskets is not connected to any of the two flow paths and does therefore not receive any higher pressure. In this case, the risk of a deformation here is particularly high. Thus, the support element is of advantage in such an embodiment.

In an embodiment of the invention the first gasket and the second gasket are connected. This simplifies the mounting of the gasket arrangement to the heat exchanger plate.

In an embodiment of the invention the support element has a thickness corresponding to a distance between two adjacent heat exchanger plates. Thus, the support element contacts the two adjacent heat exchanger plates when the heat exchanger plates are stacked together. Thus, a deformation of the heat exchanger plates in the opening area can reliably be prevented.

In an embodiment of the invention the support element supports the gasket arrangement against forces produced by a pressure in the flow path. The gasket rests against the support element so that the gasket is prevented from being pushed out of position by forces of a fluid flowing in the heat transferring section, i.e. in the flow path.

In an embodiment of the invention the opening area comprises a number of grooves and the support element comprises a number of sections which are arranged in the grooves. The support element is held in position by means of a positive locking. Thus, the support element cannot be pushed out of position by forces produced by pressures in one of the flow paths.

In an embodiment of the invention the grooves are arranged at an acute angle to a longer side of the heat exchanger plate and at an acute angle to a shorter side of the heat exchanger plate. Thus, the grooves are diagonal grooves.

In an embodiment of the invention the sections are connected by means of a first connector and the border of the opening area on the side of the fluid path and/or by means of a second connector at the opening. The sections together with the first and/or second connector form a single element which facilitates mounting of the support element to the heat exchanger plate.

In an embodiment of the invention the support element is made of a plastic material. The support element does not come into contact with a fluid in one of the flow paths. Thus, it can be made of a cheap material which is not resistant to the fluid.

In an embodiment of the invention the support element is a 3D printed element. This is a simple way to produce the support element.

In an embodiment of the invention the opening is a first opening in a first opening area and the heat exchanger plate comprises a second opening in a second opening area, wherein the first opening area is connected to and the second opening area is sealed against one of the flow paths and the first opening area is sealed against and the second opening area is connected to the other of the two flow paths, wherein a second support element is arranged in the second opening area. The second support element has the same function as the first mentioned support element. It prevents the heat exchanger plate from being deformed in the opening area.

In an embodiment of the invention the second support element is permeable for fluids. Thus, it does not form a significant flow resistance for a flow flowing in one of the flow paths.

In an embodiment of the invention the second support element comprises at least one channel. The channel allows a fluid to pass.

In an alternative or additional embodiment, the second support element is porous. A porous support element allows likewise passing of a fluid.

BRIEF DESCRIPTION OF THE DRAWINGS

The invention will now be described in more detail with reference to the drawing, wherein.

DETAILED DESCRIPTION

Figure 1:
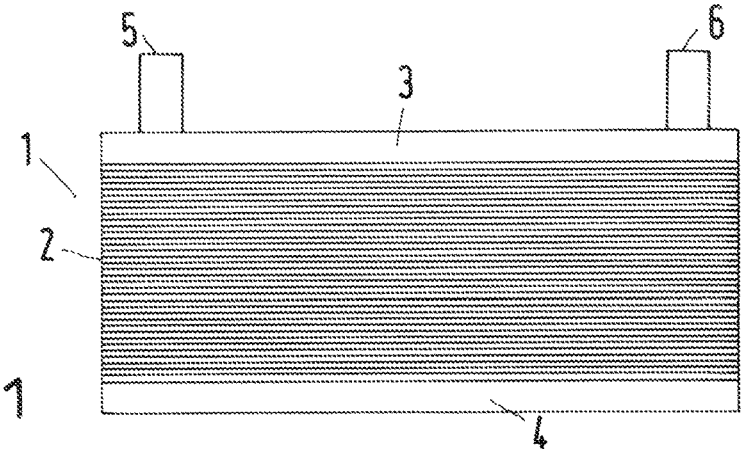
FIG. 1 shows a schematic view of a plate-type heat exchanger.

FIG. 1 shows a side view of a plate-type heat exchanger 1 having a stack of heat exchanger plates 2 between a top plate 3 and a bottom plate 4. The heat exchanger 1 comprises four ports 5, 6 (only two of them are shown).

The heat exchanger 1 defines a first fluid path and a second fluid path which are arranged in a heat transferring relation. The heat transfer occurs via the heat exchanger plates 2. Thus, every second space between the heat exchanger plates 2 belongs to the first fluid path and the other spaces belong to the second fluid path.

Figure 2:
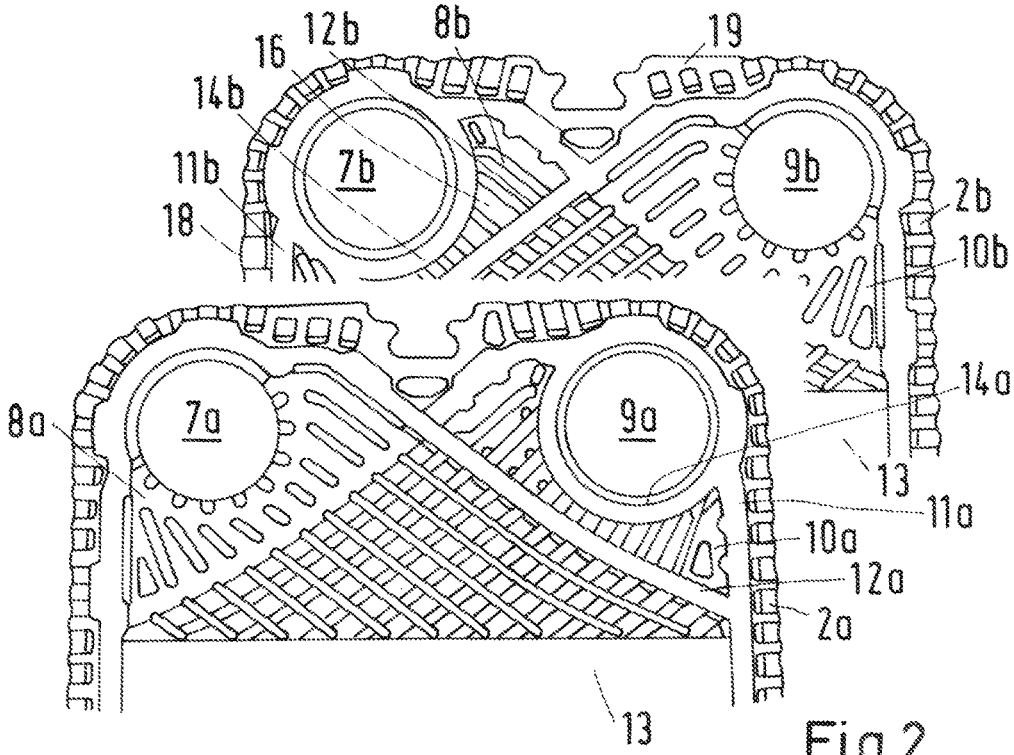
FIG. 2 shows two heat exchanger plates to demonstrate the problem underlying the invention.

FIG. 2 shows schematically two heat exchanger plates 2*a*, 2*b* which are also termed "upper heat exchanger plate" 2*a* and "lower heat exchanger plate" 2*b*.

Each heat exchanger plate 2*a*, 2*b* comprises a first opening 7*a*, 7*b* in a first opening area 8*a*, 8*b* and a second opening 9*a*, 9*b* in a second opening area 10*a*, 10*b*.

The heat exchanger plates 2*a*, 2*b* are identical. However, the lower heat exchanger plate 2*b* is rotated about 180° about an axis running between the two openings 7*b*, 9*b*.

When the heat exchanger plates 2*a*, 2*b* are stacked together, the openings 7*a*, 7*b* form a thoroughgoing channel through the stack of heat exchanger plates 2 which is connected to one of the ports 5, 6. The other openings 9*a*, 9*b* form likewise a channel which is connected to another port of the heat exchanger 1.

Fluid flowing through the openings 7*a*, 7*b* is allowed to enter a space above the upper heat exchanger plate 2*a*, but must not enter a space between the upper heat exchanger plate 2*a* and the lower heat exchanger plate 2*b*. Likewise, fluid flowing through the openings 9*a*, 9*b* must not enter a space above the upper heat exchanger plate 2*a*, but can enter a space between the upper heat exchanger plate 2*a* and the lower heat exchanger plate 2*b*.

To direct the fluid in the desired way into the respective spaces, a first gasket arrangement 11*a* is provided at the upper heat exchanger plate 2*a* and a similar gasket arrangement 11*b* is provided at the lower heat exchanger plate 2*b*. The first gasket arrangement 11*a* comprises a first gasket 12*a* between the first opening area 10*a* and a heat transfer area 13. Furthermore, the first gasket arrangement 11*a* comprises a second gasket 14*a* surrounding the opening 9*a*. The second gasket arrangement 11*b* is of similar form having a first gasket 12*b* and a second gasket 14*b*. Both gasket arrangements 11*a*, 11*b* are integrally formed, i.e. the first gasket 12*a* and the second gasket 14*a* are connected.

This leads, however, to a problem, since the second opening area 10*a* is not connected to any of the flow paths and thus not loaded by pressure. Thus, a pressure acting between the upper heat exchanger plate 2*a* and the lower heat exchanger plate 2*b* could deform the upper heat exchanger plate 2*a* in the area of the second opening area 10*a*. The same is true for the first opening area 8*b* of the lower heat exchanger plate 2*b*.

Figure 3:
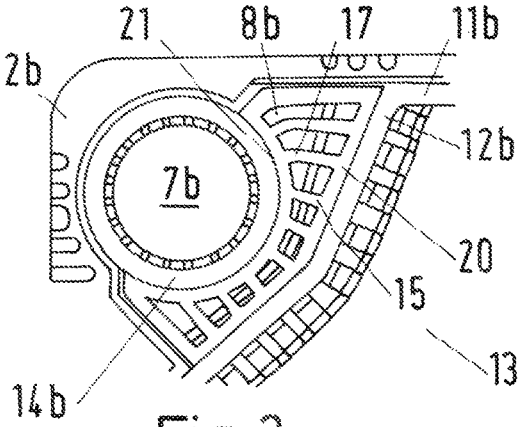
FIG. 3 shows a heat exchanger plate including a support element and FIG. 4 shows in a sectional view a schematic illustration of a support element and a gasket.
Figure 4:
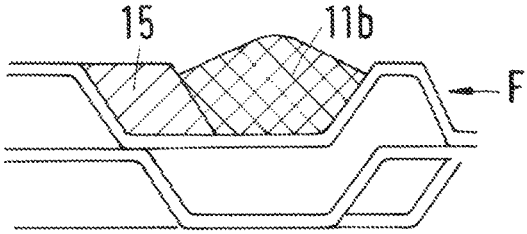

In order to prevent such a deformation, a support element 15 is used which is shown in FIGS. 3 and 4 only.

FIG. 3 shows the lower heat exchanger plate 2*b*, the first opening 7*b* and the first opening area 8*b* only. The same support element 15 can be used in the second opening area 10*a* of the upper heat exchanger plate 2*a*.

The support element 15 has a thickness corresponding to a distance between two adjacent plates, i.e. to a distance between the upper heat exchanger plate 2*a* and the lower heat exchanger plate 2*b*. This means that the support element in the mounted state contacts both adjacent heat exchanger plates.

The first opening area 8*b* comprises a number of grooves 16 (FIG. 2) and the support element 15 comprises a number of sections 17 which are arranged in the grooves 16. This produces a form fit between the support element 15 and the heat exchanger plate 2*b*. The grooves 16 run diagonally, i.e. they are arranged at an acute angle to a longer side 18 of the heat exchanger plate 2*b* and at an acute angle to a shorter side 19 of the heat exchanger plate.

Nevertheless, the sections 17 of the support element 15 are connected by a first connector 20 at the border of the first opening area 8*b* on the side of the fluid path or heat transfer area 13 and/or by means of a second connector 21 at the first opening 7*b*. Thus, the support element 15 can be handled in one piece facilitating the mounting of the support element 15.

FIG. 4 schematically shows that the support element 15 supports the gasket arrangement 11*b* against forces F produced by a pressure of the fluid in the heat transferring section 13. The gasket arrangement 11*b* rests against the surface of the support element 15. The support element 15 prevents the gasket arrangement 11*b* from being pushed out of the position by the forces F produced by the pressure of the fluids in the heat transferring section 13.

In an embodiment not shown in the drawing, a second support element can be used in an opening area not sealed against the heat transferring section 13, i.e. in the first opening area 8*a* in the upper heat exchanger plate 2*a* and in the second opening area 10*b* in the lower heat exchanger plate 2*b*.

In this case, the second support element is permeable for fluids. This can be achieved by providing the second support element with at least one channel or by making the second support element porous.

In any case, the support element 15 or the second support element can be produced by e.g. casting or 3D printing.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A plate-type heat exchanger comprising a stack of heat exchanger plates forming a first flow path and a second flow path, wherein each heat exchanger plate comprises an opening in an opening area, the opening area being connected to one of the two flow paths and sealed against the other of the two flow paths by means of a gasket arrangement, wherein a support element is arranged in the sealed opening area, wherein the support element is a different element than the gasket arrangement, and wherein the opening area comprises a plurality of grooves and the support element comprises a plurality of sections which are arranged in the grooves.

2. The heat exchanger according to claim 1, wherein the gasket arrangement comprises a first gasket between the other of the two flow paths and the opening area and a second gasket between the support element and the opening.

3. The heat exchanger according to claim 2, wherein the first gasket and the second gasket are connected.

4. The heat exchanger according to claim 3, wherein the support element has a thickness corresponding to a distance between two adjacent heat exchanger plates.

5. The heat exchanger according to claim 3, wherein the support element supports the gasket arrangement against forces produced by a pressure in the one of the two flow paths.

6. The heat exchanger according to claim 2, wherein the support element has a thickness corresponding to a distance between two adjacent heat exchanger plates.

7. The heat exchanger according to claim 2, wherein the support element supports the gasket arrangement against forces produced by a pressure in the one of the two flow paths.

8. The heat exchanger according to claim 2, wherein the support element is made of a plastic material.

9. The heat exchanger according to claim 1, wherein the support element has a thickness corresponding to a distance between two adjacent heat exchanger plates.

10. The heat exchanger according to claim 1, wherein the support element supports the gasket arrangement against forces produced by a pressure in the one of the two flow paths.

11. The heat exchanger according to claim 1, wherein the grooves are arranged at an acute angle to a longer side of the heat exchanger plate and at an acute angle to a shorter side of the heat exchanger plate.

12. The heat exchanger according to claim 11, wherein the sections are connected by means of a first connector at the border of the opening area on the side of the fluid path and/or by means of a second connector at the opening.

13. The heat exchanger according to claim 1, wherein the support element is made of a plastic material.

14. The heat exchanger according to claim 1, wherein the support element is a 3D printed element.

15. The heat exchanger according to claim 1, wherein the opening is a first opening in a first opening area and each heat exchanger plate comprises a second opening in a second opening area, wherein the first opening area is connected to one of the two flow paths, and the second opening area is sealed against one of the flow paths and the first opening area is sealed against the other of the two flow paths, and the second opening is connected to the other of the two flow paths, wherein a second support element is arranged in the second opening area.

16. The heat exchanger according to claim 15, wherein the second support element is permeable for fluids.

17. The heat exchanger according to claim 16, wherein the second support element comprises at least one channel.

18. The heat exchanger according to claim 16, wherein the second support element is porous.

19. The heat exchanger according to claim 1, wherein the plurality of grooves extend in a direction from the opening towards the gasket arrangement.

20. The heat exchanger according to claim 1, wherein the sections are connected by means of a first connector at the border of the opening area on the side of the fluid path and by means of a second connector at the opening.

* * * * *